US009051673B2

(12) United States Patent
Frey et al.

(10) Patent No.: US 9,051,673 B2
(45) Date of Patent: Jun. 9, 2015

(54) METHOD AND APPARATUS FOR CONVEYING AND TREATING A WEB

(71) Applicants: Detlef Frey, Niederkassel (DE); Peter Schlag, Troisdorf (DE); Hans-Georg Geus, Niederkassel (DE); Claudio Cinquemani, Cologne (DE)

(72) Inventors: Detlef Frey, Niederkassel (DE); Peter Schlag, Troisdorf (DE); Hans-Georg Geus, Niederkassel (DE); Claudio Cinquemani, Cologne (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 0 days.

(21) Appl. No.: 14/093,168

(22) Filed: Nov. 29, 2013

(65) Prior Publication Data

US 2014/0150305 A1 Jun. 5, 2014

(30) Foreign Application Priority Data

Dec. 3, 2012 (EP) ..... 12195251

(51) Int. Cl.

| | |
|---|---|
| ***D06F 67/02*** | (2006.01) |
| ***D06F 61/00*** | (2006.01) |
| ***D04H 3/14*** | (2012.01) |
| *B30B 3/00* | (2006.01) |
| *D06C 15/02* | (2006.01) |

(52) U.S. Cl.

CPC . *D06C 15/02* (2013.01); *D04H 3/14* (2013.01)

(58) Field of Classification Search

CPC ..... D06F 67/02; D06F 63/00; D06F 67/06; D06F 67/10; D06F 61/00; D06F 61/02; D06F 61/04; B30B 3/00; D06C 15/00; D06C 15/02; D06C 15/06; D06C 15/08

See application file for complete search history.

(56) References Cited

U.S. PATENT DOCUMENTS

| | | | | |
|---|---|---|---|---|
| 4,364,892 | A * | 12/1982 | Rehlen et al. | 264/284 |
| 4,566,781 | A * | 1/1986 | Kuehnle | 399/240 |
| 4,716,802 | A | 1/1988 | O'Connor et al. | |
| 4,814,204 | A * | 3/1989 | Carey et al. | 427/286 |
| 5,484,641 | A | 1/1996 | Rotter | |
| 5,787,809 | A * | 8/1998 | Bosse | 101/226 |
| 2001/0035978 | A1 * | 11/2001 | Sugaya et al. | 358/304 |
| 2003/0041953 | A1 * | 3/2003 | Farell et al. | 156/181 |
| 2006/0198671 | A1 * | 9/2006 | Kawahata | 399/329 |
| 2006/0223405 | A1 * | 10/2006 | Pourdeyhimi et al. | 442/361 |

FOREIGN PATENT DOCUMENTS

JP 2001288667 A 10/2001

* cited by examiner

*Primary Examiner* — Ismael Izaguirre
(74) *Attorney, Agent, or Firm* — Andrew Wilford

(57) ABSTRACT

A method of conveying and treating a web, wherein the web is first conveyed over a transport surface and then over a rotating transfer roller at the end of the transport surface. The web is transferred from the transfer roller to a treatment roller at a spacing from the transfer roller. The conveying of the web is performed with the proviso and particularly a spacing a between the transfer roller and the treatment roller is set such that the web wraps around the treatment roller over a wrap angle α from 15° to 90°.

12 Claims, 1 Drawing Sheet

METHOD AND APPARATUS FOR CONVEYING AND TREATING A WEB

FIELD OF THE INVENTION

The invention relates to a method of conveying and treating a web, particularly a web made of fibers. The invention also relates to an apparatus for carrying out this method. The web is preferably a nonwoven web of fibers or continuous filaments. with respect to the invention, the term "treatment" refers to a plurality of processing actions for a web. In particular, "treatment" refers to the compaction of a web and preferably the compaction of a nonwoven web by calendering.

BACKGROUND OF THE INVENTION

A method and apparatus of the type described above are known in the industry in a very wide variety of embodiments, particularly for nonwoven and spunbond webs. During the is manufacture of spunbond textile, continuous filaments in the form are usually deposited in a tangle on a continuously passing deposition mesh belt. The resulting nonwoven web is then normally compacted, particularly by thermal bonding in a calender comprising, for example, two heated calender rollers. Here, the nonwoven web is fed through the gap or nip between two calender rollers. For this purpose, the nonwoven web must be passed from the deposition mesh belt or from a transfer roller at the end of the deposition mesh belt to the calender. In the methods known in the industry, this transfer or detachment of the nonwoven web requires a relatively great force. Particularly at high production speeds and/or with low nonwoven web grammage, this big force often leads to negative impacts on the product characteristics and, above all, to a reduction in strength transverse to the machine direction or transverse to the travel direction of the web. The high forces can even cause the nonwoven web to tear. During the subsequent thermal calendering of the nonwoven web with heated calender rollers, so-called bonding points are created between the continuous filaments of thermoplastic and the nonwoven web or spunbond textile is compacted as a result. At higher production speeds and higher deposition mesh belt speeds, this compaction of the spunbond textile often leaves something to be desired. Above all, this has a negative impact on the strength of the nonwoven web transverse to the machine or travel direction. At higher speeds, the dwell time in the calender is often insufficient, so the energy transfer to the nonwoven web is unsatisfactory. The quality of the bonding points between the filaments is then also insufficient. Moreover, due to the higher deposition mesh belt speeds, the filaments are aligned more in the direction of production or travel in any case, and this results in a deterioration of the strength transverse to the travel direction.

OBJECT OF THE INVENTION

By contrast, the object of the invention is to provide a method of the type described above with which optimum strengths of the web, particularly optimum strengths transverse to the travel direction of the web can be achieved even at high production speeds.

Another object of the invention is to provide a commensurate apparatus for carrying out the method.

SUMMARY OF THE INVENTION

To attain this object, the invention teaches a method of conveying and treating a web of fibers and/or filaments where the web is first conveyed over a transport surface and then over a rotating transfer roller at the end of the transport surface, the web is then transferred from the transfer roller to or onto at least one rotating treatment roller at a spacing from the transfer roller in the travel direction of the web downstream of the transfer roller, the conveying of the web being performed with the proviso that particularly a spacing a between the transfer roller and the treatment roller is set such that the web wraps around the transfer roller over a wrap angle of 15° to 90° before it is transferred to the treatment roller. According to a very preferred embodiment of the invention, the web is a nonwoven web and is particularly a nonwoven or a spunbond textile made of continuous filaments. The continuous filaments then advantageously consist of thermoplastic. In principle, however, webs of staple fibers or the like can also be used in relation to the invention.

It lies within the scope of the invention that the transport surface is a horizontal transport surface or a substantially horizontal transport surface. The web is conveyed over the transport surface or with the transport surface toward the transfer roller. It lies within the scope of the invention that the web initially follows the rotation of the transfer roller downward, thus resulting in it wrapping around the transfer roller over a wrap angle $\alpha$. In doing so, the web need not lie directly against the transfer roller. Preferably, a conveyor belt or deposition mesh belt running over the transfer roller is between the transfer roller and the web in the wrapping area of the transfer roller. It is recommended that the wrapping-around of the transfer roller take place on the side of the transfer roller facing the treatment roller. It lies within the scope of the invention that the web is not supported or reinforced in the space between the transfer roller and the treatment roller and hangs freely, as it were, in the space. It also lies within the scope of the invention that the web droops, as it were, into the space between the transfer roller and the treatment roller as a result of gravity. It is recommended that the transfer roller and the treatment roller rotate in the same direction. Preferably, the transfer roller and the treatment roller rotate at the same rotational speed or substantially the same rotational speed. The treatment roller particularly serves to treat or process the web. According to a preferred embodiment, the treatment roller serves to compact the web and is particularly—as explained further below—a component of a calender. In principle, however, the treatment roller could also only convey or forward the web.

The wrap angle $\alpha$ is measured between a first imaginary radius that extends from the rotation axis of the transfer roller and is perpendicular or substantially perpendicular to the transport surface, and a second imaginary radius that extends from the rotation axis of the transfer roller and the last or lowermost point of contact of the web with the transfer roller. The invention is based on the discovery that the resulting force for the detachment of the web from the transfer roller or from the deposition mesh belt running over the transfer roller can be minimized by the inventive wrapping-around of the transfer roller. In the methods known in the industry, no inventive wrapping-around of the transfer roller is provided. Here, the detachment of the web generally occurs almost immediately after the transfer of the web from the transport surface to the transfer roller and hence tangentially to the transport surface or to the direction of the deposition mesh belt. The resulting force during detachment of the web is relatively large at this point, and it is particularly brought about by the adhesion of the web to the substrate or to the deposition mesh belt. The product characteristics of the web can be negatively impacted as a result of this force effect, and this force can lead to tearing of the web. Especially with webs having lower grammage and at higher production speed, the force effect is significant in previously known methods and leads to substantial changes in the product characteristics and particularly to a reduction of the strength of the web and above all of the strength of the web transverse to the travel direction. By contrast, the invention is based on the discovery that, by virtue of the inventive wrapping-around, the resulting force directed at the treatment roller and to the calender can be substantially reduced or minimized. Negative influences on the product characteristics upon detachment of the web from the substrate or from the deposition mesh belt can thus be prevented to a large extent.

It lies within the scope of the invention that the web passes over the upper side of the transfer roller and over the upper side of the treatment roller, and that the upper side of the transfer roller and the upper side of the treatment roller are either at the same height or at substantially the same height or have a height difference that is a maximum of 20%, preferably a maximum of 10% and especially preferably a maximum of 5% of the diameter of the transfer roller. The upper side of a roller refers here particularly to the highest point of a roller. The above-mentioned height difference is measured vertically between the upper side of the transfer roller and the upper side of the treatment roller.

According to an especially preferred embodiment of the invention, the treatment roller is a lower treatment roller, and the web is passed through a gap or through a nip between the lower treatment roller and an upper treatment roller above it. The two treatment rollers are preferably used to compact and/or solidify the web. According to a recommended embodiment of the invention, the two treatment rollers have the same diameter or substantially the same diameter. According to an especially preferred embodiment of the invention, the treatment rollers are a component of a calender. It therefore lies within the scope of the invention that the lower and the upper treatment roller are two calender rollers. It also lies within the scope of the invention that the web is compacted upon being gripped between the two calender rollers—preferably by means of thermal bonding. It is recommended that at least one calender roller be heated. In principle, both calender rollers can also be heated. It is recommended that compaction of a spunbond textile occurs in the calender or between the two calender rollers by means of thermal bonding. During thermal bonding, bonding points or connection points between the continuous filaments of a spunbond textile are created. The continuous filaments are advantageously made of thermoplastic.

It lies within the scope of the invention that the web is conveyed such that the spacing a between the transfer roller and the treatment roller or the lower treatment roller is set such that the web wraps around the treatment roller over a wrap angle $\beta$ of 10° to 90°, preferably from 20° to 60°. It is recommended that the wrap angle $\beta$ be greater than 15°. The wrap angle $\beta$ is advantageously measured between a first imaginary radius that extends from the rotation axis of the treatment roller or of the lower treatment roller, as well as through the uppermost point of this treatment roller, and a second imaginary radius that also extends from the rotation axis of the treatment roller or of the is lower treatment roller, as well as through the first or lowermost point of contact between the web and this treatment roller. By wrapping around the treatment roller, a longer contact time is achieved between the web and the treatment roller in comparison to methods known in the industry. With a heated calender roller, this means a longer dwell time and a preheating of the web, thus ultimately resulting in more effective compaction and thermal bonding. Sufficient strength on the part of the web is also ensured in this way.

According to an especially preferred embodiment of the invention, the is conveyed such that particularly the spacing a between the transfer roller and the treatment roller or the lower treatment roller is set such that the web, before being transferred to the treatment roller, wraps around the transfer roller over a wrap angle $\alpha$ of 40 to 90%, preferably from 60 to 90% and especially preferably from 75 to 90%.

It is recommended that the spacing a between the transfer roller and the treatment roller or the lower treatment roller be set such that it is less than 15%, preferably less than 10% and especially preferably less than 8% of the diameter of the transfer roller. The spacing a is advantageously at least 3% or at least 4% or at least 5% of the diameter of the transfer roller. The spacing a is particularly measured between the two nearest surface points of the transfer roller on the one hand and of the treatment roller or lower treatment roller on the other hand. Preferably, the spacing a is 8 to 30 mm, particularly 10 to 25 mm, preferably 10 to 20 mm and especially preferably 12 to 18 mm.

The subject matter of the invention also includes an apparatus for conveying and treating a web, particularly of a web made of fibers, in which a transport surface is provided for the planar conveying of the web to a transfer roller at the end of the transport surface and furthermore at least one treatment roller for receiving the web from the transfer roller is present and the treatment roller is in the travel direction of the web downstream of the transfer roller at a spacing a from the transfer roller and the spacing a between the transfer roller and the treatment roller is set such that the conveyed web, before being transferred to the treatment roller, wraps around the transfer roller over a wrap angle $\alpha$ of over 15°.

It lies within the scope of the invention that the transport surface is formed by of a continuously circulating conveyor belt, particularly by a continuously circulating deposition mesh belt. In other words, the conveyor or deposition mesh belt forms the transport surface, particularly the horizontal or substantially horizontal transport surface. It also lies within the scope of the invention that the transfer roller is a deflecting roller for the conveyor belt or for the continuously circulating deposition mesh belt. Then, the transfer roller is on an upstream end of a conveyor belt assembly or of a deposition mesh belt assembly. In the wrapping region of the transfer roller, the conveyor belt or the deposition mesh belt is then between the transfer roller and the web.

According to a recommended embodiment of the invention, the diameter of the treatment roller or calender roller, particularly the diameter of the two treatment rollers or calender rollers one over the other is greater than the diameter of the transfer roller and is preferably at least 1.5 times, preferably 2 times the diameter of the transfer roller.

The invention is based on the discovery that, by virtue of the inventive convey and/or treatment measures, there are no disadvantageous influences of the product characteristics for the web in comparison to the measures known in the industry. In particular, the web is not damaged. Particular emphasis must be placed on the fact that, even at high production speeds, an optimum strength of the web and, above all, an optimum strength of the web transverse to the machine direction or travel direction can be achieved. It must also be emphasized that the inventive measures can be implemented without noteworthy effort and expense compared to the previously used measures. The advantages described above are especially pronounced in webs in the form of nonwoven webs, particularly in spunbond textile of continuous filaments and above all in spunbond textile of continuous filaments of thermoplastic. According to an especially preferred embodiment of the invention, the continuous filaments of a spunbond textile treated according to the invention are made of polypropylene or substantially of polypropylene.

BRIEF DESCRIPTION OF THE DRAWING

In the following, the invention is explained in further detail with reference to a schematic drawing that illustrates only one illustrated embodiment. Therein.

SPECIFIC DESCRIPTION OF THE INVENTION

Figure 1:
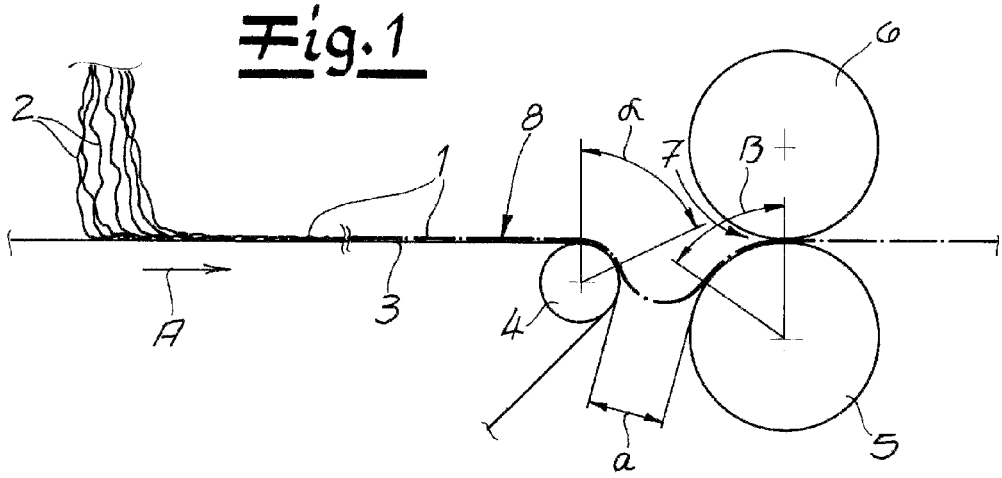
FIG. 1 is a side view of an apparatus according to the invention for carrying out the method according to the invention.

FIG. 1 shows an apparatus for carrying out the method according to the invention for conveying and treating a web. According to an especially preferred embodiment and as illustrated, the web is a nonwoven web or a spunbond textile 1 of continuous filaments 2, the continuous filaments 2 preferably of polypropylene. It is recommended that the continuous filaments 2 be spun from a spinning nozzle (not shown), cooled, and preferably drawn and then deposited onto a deposition mesh belt 3 as the nonwoven web or spunbond textile 1 (left side of FIG. 1). The belt 3 is preferably a continuously circulating conveyor/deposition mesh belt 3. The deposition mesh belt 3 advantageously forms a horizontal support surface 8 for the spunbond textile 1. The nonwoven web or spunbond textile 1 is conveyed from left to right in FIG. 1, as indicated by arrow A. The deposition mesh belt 3 is reeved over a rotating transfer roller 4, and the web or the spunbond textile 1 is thus conveyed on the horizontal surface 8 of the deposition mesh belt 3 to this transfer roller 4 at the end of the transport surface 8. Preferably, and in the illustrated embodiment, the spunbond textile 1 is then transferred from the transfer roller 4 to a treatment stage in the form of two calender rollers 5 and 6, one above the other. The spunbond textile 1 is passed through a gap or nip 7 between the calender rollers 5 and 6 and compacted there by thermal bonding. In the illustrated embodiment, the lower calender roller 5 may be heated.

It lies within the scope of the invention that the spacing a between the transfer roller 4 and the lower calender roller 5 is set such that the web wraps around the transfer roller 4 over a wrap angle $\alpha$ of preferably 30° to 90°. In the illustrated embodiment, this wrap angle $\alpha$ is about 65°. By virtue of the spacing between the transfer roller 4 and the calender rollers 5 and 6 and due to gravity, the spunbond textile 1 follows the rotation of the transfer roller 4 downward. The result of this is the wrap-around angle $\alpha$. The spacing a between the transfer roller 4 and the lower calender roller 5 also causes the spunbond textile 1 to droop, as it were, between the transfer roller 4 and the calender rollers 5 and 6. Preferably, and in the illustrated embodiment, the spacing a is measured between the nearest surface point on the transfer roller 4 on the one hand and on the lower calender roller 5 on the other hand. Another consequence of this spacing a is that the spunbond textile 1 wraps around the lower calender roller 5 over a wrap angle $\beta$ that is particularly 15° to 60°. As a result, a longer dwell time of the spunbond textile 1 on the heated lower calender roller 5 is achieved, thus preheating the nonwoven web 1 and enabling the thermal bonding in the nip 7 between the calender rollers 5 and 6 to be carried out more effectively. In the illustrated embodiment, the wrap angle $\beta$ is about 55°.

FIG. 1 shows that the spunbond textile 1 is preferably passed over the upper side of the transfer roller 4 and over the is upper side of the lower calender roller 5. Preferably, and in the illustrated embodiment, the uppermost part of the upper side of the transfer roller 4 and the uppermost part of the upper side of the lower calender roller 5 are at the same height or at about the same height. FIG. 1 also shows that the diameters of the calender rollers 5 and 6 is greater than the diameter of the transfer roller 4. Preferably, the diameter of the calender rollers 5 and 6 is greater than twice the diameter of the transfer roller 4. The spacing a between the transfer roller 4 and the lower calender roller 5 is preferably set such that the inventive wrap angle $\alpha$ is produced and the wrap angle $\beta$ is preferably also produced at the lower calender roller 5.

Figure 2:
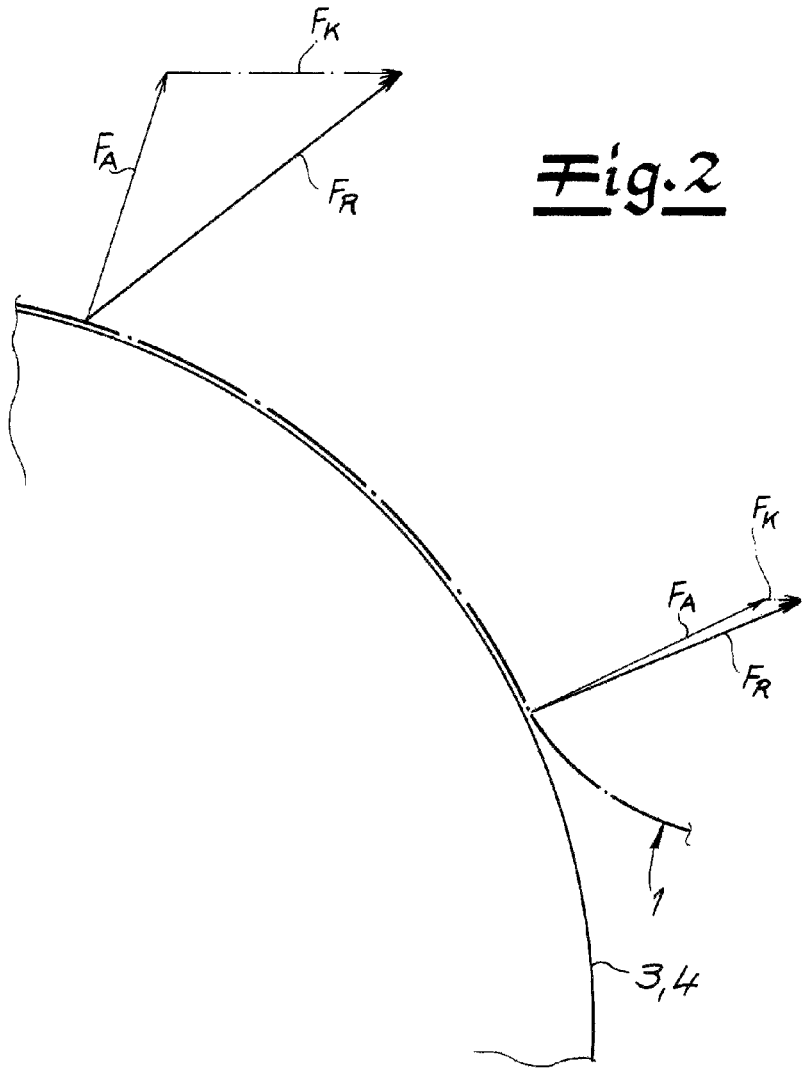
FIG. 2 is a section of FIG. 1 showing force vectors.

FIG. 2 shows the force relationships on detachment of the web or of the spunbond textile 1 from the deposition mesh belt 3 on the transfer roller 4. The force relationships for a method according to the prior art are illustrated in the upper portion and those for the method according to the invention are illustrated with the aid of force vectors in the lower portion. The detachment force $F_A$ is the same in the both cases and extends orthogonally to the deposition mesh belt 3. In the prior art, the force $F_K$ that is required for conveying into the nip 7 of the calender rollers 5 and 6 is aligned almost tangentially to the direction of the deposition mesh belt 3. In the method according to the prior art, the resulting force $F_R$ is very high. The product characteristics of the spunbond textile 1 can be negatively impacted as a result. In the method according to the invention (in the bottom portion of FIG. 2), the detachment force $F_A$ is already aligned in the direction of the nip 7 of the calender rollers 5 and 6. Consequently, the force $F_K$ that is required for conveying into the nip 7 is very small, so the resulting force $F_R$ is also substantially less than the resulting force in the method according to the prior art. The product characteristics of the spunbond textile 1 are therefore negatively impacted less than in the method according to the prior art.

The invention claimed is:

1. A method of conveying and treating a web made of fibers, the method comprising the steps of:

first conveying the web on a transport surface and then over a rotating transfer roller at a downstream end of the transport surface, transferring the web from the transfer roller to a rotating treatment roller at a spacing from the transfer roller in the travel direction of the web, and setting a speed of the conveying of the web and a spacing of the treatment roller from the transfer roller such that the web wraps around the transfer roller over a wrap angle of 15° to 90°.

2. The method as set forth in claim 1, wherein the web is a nonwoven or a spunbond textile made of continuous filaments.

3. The method as set forth in claim 1, wherein the web passes over the upper side of the transfer roller and over the upper side of the treatment roller and the upper side of the transfer roller, and the upper side of the treatment roller are either at the same height or at substantially the same height or have a height difference that is a maximum of 20% of the diameter of the transfer roller.

4. The method as set forth in claim 1, wherein the treatment roller is a lower treatment roller and the web is passed through a gap or nip between the lower treatment roller and an upper treatment roller above it.

5. The method as set forth in claim 4, wherein the lower and the upper treatment rollers are two calender rollers, at least one of the calender rollers being heated and the web being compacted on passage between the two calender rollers.

6. The method as set forth in claim 1, further comprising the step of:

setting a spacing a between the transfer roller and the treatment roller such that the web wraps around the treatment roller over a wrap angle β of 15° to 60°.

7. The method as set forth in claim 1, further comprising the step of:

setting a spacing between the transfer roller and the treatment roller such that the web wraps around the transfer roller over a wrap angle α of 40 to 90°.

8. The method as set forth in claim 1, further comprising the step of:

setting a spacing between the transfer roller and the treatment roller such that it is greater than 4% and less than 20% of the diameter of the transfer roller.

9. An apparatus for conveying and treating a web made of fibers, the apparatus comprising:

a continuously circulating deposition mesh belt forming a transport surface for the planar conveying of the web to a rotating transfer roller at the end of the transport surface;

at least one rotating treatment roller for receiving the web from the transfer roller and in the travel direction of the web downstream of the transfer roller at a spacing a from the transfer roller, the spacing a between the transfer roller and the treatment roller being such that the conveyed web wraps around the transfer roller over a wrap angle α of over 15°.

10. The apparatus as set forth in claim 9, wherein the transfer roller is a deflecting roller for the continuously circulating deposition mesh belt.

11. The apparatus as set forth in claim 9, wherein a diameter of the treatment roller is at least 1.5 times a diameter of the transfer roller.

12. A method of operating an apparatus for conveying and treating a web made of fibers, the apparatus comprising:

a support surface moving and extending in a horizontal travel direction and passing at a downstream end over a transfer roller; and a rotating treatment roller positioned downstream in the direction at a spacing from the transfer roller, whereby the web is transported downstream on the surface, passes over the transport roller, passes through the spacing to the treatment roller, engages the treatment roller, and is pulled off the transfer roller and conveyed away by the treatment roller, the method comprising the step of conveying the web on the support surface and setting the spacing between the transfer roller and the treatment roller such that the web wraps around the transfer roller over a wrap angle of 15° to 90°.

* * * * *